US010028063B2

(12) United States Patent
Ishiguro et al.

(10) Patent No.: US 10,028,063 B2
(45) Date of Patent: Jul. 17, 2018

(54) SPATIAL FREE-FORM INTERACTIVE SPEAKERS

(71) Applicant: Disney Enterprises, Inc., Burbank, CA (US)

(72) Inventors: Yoshio Ishiguro, Pittsburgh, PA (US); Alexander Rothera, Treviso (IT); Ali Israr, Monroeville, PA (US); Eric Brockmeyer, Pittsburgh, PA (US)

(73) Assignee: Disney Enterprises, Inc., Burbank, CA (US)

( * ) Notice: Subject to any disclaimer, the term of this patent is extended or adjusted under 35 U.S.C. 154(b) by 49 days.

(21) Appl. No.: 14/482,715

(22) Filed: Sep. 10, 2014

(65) Prior Publication Data

US 2015/0181347 A1 Jun. 25, 2015

Related U.S. Application Data

(63) Continuation-in-part of application No. 14/138,484, filed on Dec. 23, 2013, now Pat. No. 9,544,696.

(51) Int. Cl.
*H04R 17/00* (2006.01)
*H04R 19/02* (2006.01)

(52) U.S. Cl.
CPC ..... *H04R 19/02* (2013.01)

(58) Field of Classification Search
USPC ..... 381/182, 113, 116
See application file for complete search history.

(56) References Cited

U.S. PATENT DOCUMENTS 5,309,519 A * 5/1994 Park ..... H04R 1/028 381/190
6,332,029 B1 * 12/2001 Azima ..... B42D 15/022 181/166
2003/0138120 A1 * 7/2003 Tripoli, III ..... H04R 1/34 381/190
2004/0013274 A1 * 1/2004 Bellan ..... H04R 3/00 381/77
2008/0240472 A1 * 10/2008 Shiba ..... B06B 1/0603 381/152
2009/0041266 A1 * 2/2009 Guo ..... H03F 3/217 381/98
2014/0140551 A1 * 5/2014 Ramstein ..... H04R 17/005 381/182

* cited by examiner

*Primary Examiner* — Amir Etesam
(74) *Attorney, Agent, or Firm* — Ference & Associates LLC

(57) ABSTRACT

An embodiment provides a free-form speaker. In an embodiment, an array type electrostatic speaker is provided. In anther embodiment, a passive element that is separate from an object including an electrode is provided. The free-form speakers are lightweight and flexible, making the speakers suitable for use in a variety of unconventional implementations. Other embodiments are described and claimed.

19 Claims, 10 Drawing Sheets

SPATIAL FREE-FORM INTERACTIVE SPEAKERS

CROSS REFERENCE TO RELATED APPLICATIONS

This application is a continuation-in-part of co-pending and commonly assigned U.S. patent application Ser. No. 14/138,484, entitled "FLEXIBLE, SHAPEABLE FREE-FORM ELECTROSTATIC SPEAKERS," filed on Dec. 23, 2013, which is incorporated by reference in its entirety herein.

BACKGROUND

Sound and visuals are important ingredients for creating interactive systems that produce an engaging and believable user experience. Display technology has progressed into more flexible, scalable and free-form configurations, e.g., by use of flexible Organic Light-Emitting Diode (OLED) or projector display screens or other emerging display technologies.

Sound technology has lagged behind, relying on traditional surround sound systems limited by audible area, calibration, and bulky components. As opposed to conventional loudspeakers, a less commonly used technology for sound production is electrostatic loudspeaker (ESL) technology, which had been intensively investigated in the early 1930s through the 1950s.

BRIEF SUMMARY

In summary, one embodiment provides a free-form speaker system. In an embodiment, the system includes an audio controller, an array of free-form electrodes, one or more free-form diaphragms positioned proximate to, and being shaped to substantially match, the array of free-form electrodes, and one or more input elements coupled to the array of free-form electrodes that accept inputs from the audio controller. In an embodiment, the array of free-form electrodes is shaped to substantially match a surface shape of an object. The free-form speaker system may include a plurality of diaphragms, each of the plurality of diaphragms being positioned proximate to a corresponding free-form electrode in the array of free-form electrodes.

The one or more free-form diaphragms may be disposed in a passive element that is physically removable from the array of free-form electrodes. For example, the one or more free-form diaphragms may include a conductive layer of the passive element. The passive element may be an object such as a toy or a dish placed on to the object that includes the array of free-form electrodes, e.g., a tabletop.

In an embodiment, the free-form speaker system may include one or more free-form diaphragms that are disposed in the object containing the array of free-form electrodes. For example, the object may be selected from the group consisting of a television, a wall, a tabletop, and a suspended element.

The free-form speaker system may further include one or more elements coupled to the one or more free-form diaphragms. The one or more elements transmit audible inputs received by the one or more free-form diaphragms. By way of example, the free-form speaker system may thus be used as a microphone or audio recording system, e.g., further including a memory device that records the audible inputs in reproducible form.

An embodiment provides a free-form electrostatic speaker including an audio controller, an array of free-form electrodes, with the array of free-form electrodes being shaped to substantially match a surface shape of an object, one or more free-form diaphragms disposed in the object and positioned proximate to, and being shaped to substantially match, the array of free-form electrodes, and one or more elements coupled to the array of free-form electrodes that accept inputs from the audio controller. The object may for example be selected from the group consisting of a television, a wall, a tabletop, and a suspended element. The free-form electrostatic speaker system may be used as an audio input and/or recording system, e.g., including one or more elements coupled to the array of free-form electrodes that transmit audible inputs received by the one or more free-form diaphragms and including a memory device that records the audible inputs in reproducible form.

In another embodiment, a free-form electrostatic speaker system includes at least one free-form electrode, wherein the at least one free-form electrode is shaped to substantially match a surface shape of an object, with the at least one free-form electrode being disposed in a surface of the object such that it cooperates with a removable, passive diaphragm.

An embodiment includes a lightweight, free-form electrostatic speaker. In an embodiment, the electrostatic speaker includes at least one free-form electrode, at least one free-form diaphragm positioned proximate to, and being shaped to substantially match, the at least one free-form electrode, and one or more elements coupled to the at least one free-form electrode that accept inputs from an audio controller. In a lightweight embodiment, the at least one free-form electrode and the at least one free-form diaphragm are formed of a flexible, lightweight conductive material selected from the group consisting of conductive paper, a polyester film, a carbon sheet, indium tin oxide, and a carbon nanotube material. Thus, the lightweight, free-form electrostatic speaker may take the form of a floating object that is buoyant at 1 atmosphere pressure, e.g., a helium filled balloon made of polyester film.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
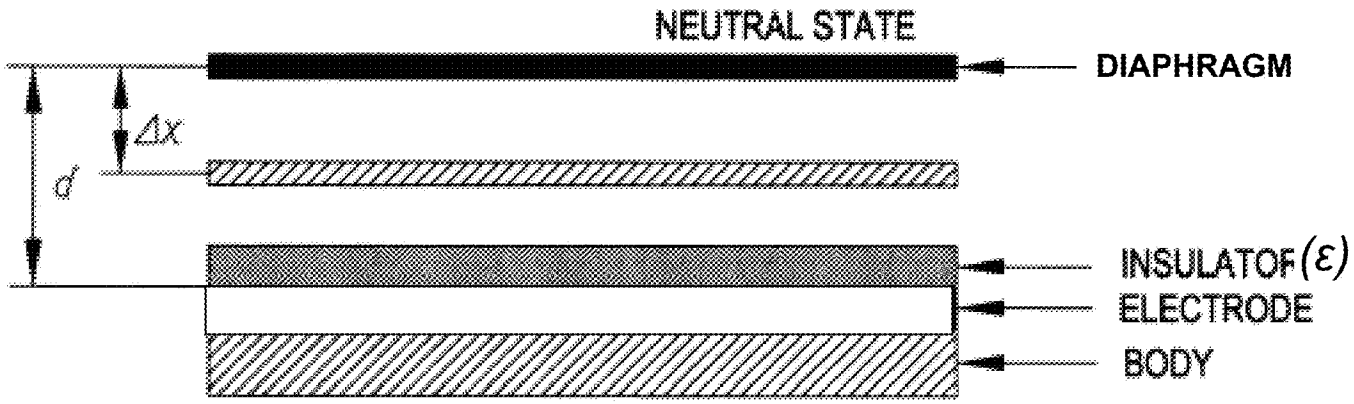
FIG. 1 Prior Art
FIG. 1 illustrates an overview of electrostatic loudspeaker (ESL) technology.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

Classic speaker technologies, as opposed to electrostatic loudspeaker (ESL) technology, by the very nature of sound production place significant constraints on their form factors, thus placing limitations on their applications. It is relatively difficult and expensive, for example, to create omni-directional speakers that produce sound equally in all directions. Moreover, it is difficult to have conventional loudspeakers integrated into complex shapes (e.g., curved shapes, wall elements, other 3D objects, etc.) or provided in lightweight implementations.

There have been many efforts to overcome the form factor limitations and produce alternative speaker designs. Film speakers, for example, can be very thin, relatively flexible and transparent, and they are usually based on piezoelectric crystal and electro-active polymers vibrating sheets of films. Stretchable speakers use silicon substrates and ionic conductors. Cylindrical speakers allow for the creation of omni-directional sound reproduction either by using PZT tubes or transducer arrays placed on cylindrical or spherical surfaces.

As taught herein, ESL technology provides speakers having almost no moving parts and can be made out of common materials. Further, electrostatic speakers may be made in a very inexpensive fashion and do not require complex assembly or involved production processes. In fact, ESLs can take virtually any geometrical shape. The ESL technology forms a basic foundation of the spatial, free-form interactive speakers described herein.

Freeform electrostatic loudspeakers include components that are selected on the basis of a particular application's requirements or the desired implementation scenario. For example, a lightweight and paper-like aluminized MYLAR sheet may be used in a balloon ESL; a solid metallic mesh may be used in a wall or tabletop ESL, etc., as further described herein. Other materials such as copper plates, conductive ink, and transparent indium tin oxide (ITO) may also be utilized. MYLAR is a registered trademark of E. I. du Pont de Nemours and Company in the United States and other countries.

A freeform electrostatic loudspeaker may be implemented in many ways with slight modification in the structure. Because of the electrostatic coupling generated between the two conductive surfaces and the relative motion between these surfaces produces sound, any one of the surfaces may be used as a diaphragm and any surface may be grounded, while the other is connected to high voltage. The quality of sound does not vary with changing the polarity of the speaker.

One feature of free-form electrostatic loudspeakers is that the entire diaphragm surface may vibrate and reproduce sound. This is different than conventional electromagnetic speakers, in which the coils around the magnet vibrate, and the motion is translated to the diaphragm. This means that loading on the loudspeaker diaphragm only hinders the movement of the surface directly under the loading. That is, other parts of the speaker will still vibrate and generate sound. Unlike a conventional speaker where the loading affects the entire sound generation process, the sound quality in electrostatic loudspeakers is only slightly depreciated with loading. Additionally, the sound emits uniformly, e.g., a user walking along a wall equipped with an electrostatic loudspeaker would feel that the sound source is moving along him/her. This is not possible with conventional speakers as the perceived sound intensity decreases as the user moves away from the speaker and vice versa. Therefore, electrostatic loudspeakers also enhance the sound listening experience.

The illustrated example embodiments will be best understood by reference to the figures. The following description is intended only by way of example, and simply illustrates certain example embodiments.

An embodiment provides a spatial free-form interactive electrostatic loudspeaker that can reproduce sound directly from architecture, furniture and many other everyday objects. Utilizing ESLs that are lightweight, flexible, scalable, that can be made into almost any shape and size, an embodiment provides sound systems that are highly durable and ideal for use in restricted spaces as well as in dynamic spaces and structures not suitable for conventional speaker technologies.

Referring to FIG. 1, the basic principles of electrostatic sound production were explored in depth in the 1930s. A thin conductive diaphragm and an electrode plate are separated by insulating materials, which can include air, with the dielectric permittivity &, as illustrated in FIG. 1. The audio signal is amplified to approximately 1000 V and then applied to the electrode, charging it relative to the ground level that is connected to the diaphragm. As the electrode is charging, an electrostatic attraction force is developed between the electrode and diaphragm. According to Columb's Law, this attractive force can be calculated as follows:

$$\vec{F} = \frac{q_1 q_1}{2\varepsilon S} = \frac{\varepsilon S V^2}{2d^2} \quad \text{[EQ 1]}$$

where ε is permittivity, S is electrode surface size, d is distance, and V is a potential difference between the electrode plate and the diaphragm. This electrostatic force would deform or displace the diaphragm by Δx (FIG. 1) and, as an alternating audio signal is provided, displacing air creating an audible signal. In other words, the diaphragm is actuated with electrostatic force to create a speaker.

The quality of the sound produced by the speaker depends on several parameters. According to EQ1, the larger the surface, the higher permittivity of the insulating material and smaller distance between plates, the higher the force created, with a larger displacement Δx, and therefore, a higher sound pressure level. The size of the electrode and diaphragm cannot be increased indefinitely: a thinner diaphragm produces better speaker response, therefore smaller and lighter speaker would be louder than a larger device with a heavy diaphragm.

The speaker forms a capacitor and, therefore, another property to be considered is the electrical time constant τ, which defines how fast the induced charge builds on the other plate of the capacitor:

$$\tau = C \cdot R = \frac{\varepsilon S R}{d} \quad \text{[EQ 2]}$$

where R is the input impedance of the speaker. A larger τ would degrade speaker response at higher frequencies and the speaker design therefore is a question of tradeoffs between loudness and the frequency response.

The conventional form of ESL (e.g., refer to FIG. 2A) has both electrode and diaphragm charged. However, this can be dangerous to the human body that normally has the same potential as ground.

Figure 2A:
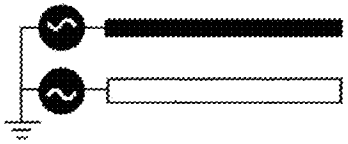
FIG. 2A Prior Art
FIG. 2(A-E) illustrates example ESL configurations.
Figure 2B:
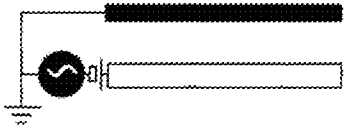

In an embodiment, the diaphragm may be connected to ground and the electrode to a high voltage (HV) signal (e.g., FIG. 2B). Furthermore, the current may be limited (e.g., ~1.25 mA), protecting the user from electrical shocks. A simple single-side configuration (FIG. 2B) thus may be safely used as the surface of tabletops (refer to FIG. 6A-B), walls or wall elements, including shaped elements (refer to FIG. 4), toys, floating objects such as a balloon, and more.

The grounded electrode protects the user touching the speaker from the high-voltage audio source, making it safe to handle and manipulate an object with embedded speakers. This becomes particularly important in the interactive applications. In such a configuration, either the diaphragm or the electrode or both may be moveable. Moreover, the high voltage audio signal may be either applied to the diaphragm or to the electrode, allowing ESLs to be utilized in variety of situations.

In practice, a low-power, high-voltage direct current power supply to amplify the sound signal up to 1000 V has been used. The output current, however, may be limited, e.g., to 1.25 mA. Therefore, when a user touches the high voltage diaphragm only, they do not feel an electrical shock. But if the user touches both the high voltage diaphragm and the ground electrode, it can provide an electric shock.

One way to prevent direct user contact with the high voltage source is to isolate the electrodes by placing them inside the objects and structures that are not accessible during interaction. In all configurations proposed in this description, (except for tangible passive loudspeakers, refer to FIG. 5(A-B)), the high voltage electrode is placed inside the structure and covered by the ground electrode. Moreover, these electrodes are insulated to reduce any mishap due to accidental contact between the user and electrode. The resulting electrostatic loudspeakers are safe but care must be taken during fabrication, testing and installation of electrostatic loudspeakers.

The single-side configuration is the simplest form of electrostatic loudspeaker and consists of two layers (a diaphragm and an electrode) separated by an insulator (illustrated generally in FIG. 1). In the example ESL speakers described herein, the ground is connected to the diaphragm and the audio signal is provided to the electrode (as illustrated in FIG. 2B). To create different potential between two conductive materials (diaphragm and electrode), they both have different potentials from the ground, as shown in FIG. 2A.

However, this arrangement may be a concern in certain implementations as the human body normally has the same potential as ground. In designing home audio speakers, for example, the choice of configuration may be irrelevant in this regard. It may become important in interactive speakers, e.g., embedded in objects that can be touched by the user. The grounded electrode thus protects the user touching the speaker from the high-voltage audio source, making it safe to handle and manipulate the object with embedded speakers. This becomes particularly relevant in the interactive applications, examples of which are described herein.

Figure 2C:
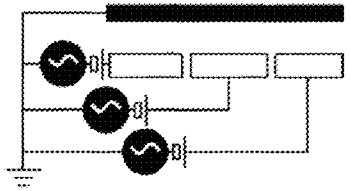

In an embodiment, an array configuration may be viewed as an extension of the single-side configuration, such as shown in FIG. 2C. The array allows ESL to be placed sequentially, where each speaker or portion thereof in the array may be independently controlled. Multiple sound patterns may be channeled through individual speakers, creating a moving and dynamic sound system.

Figure 3:
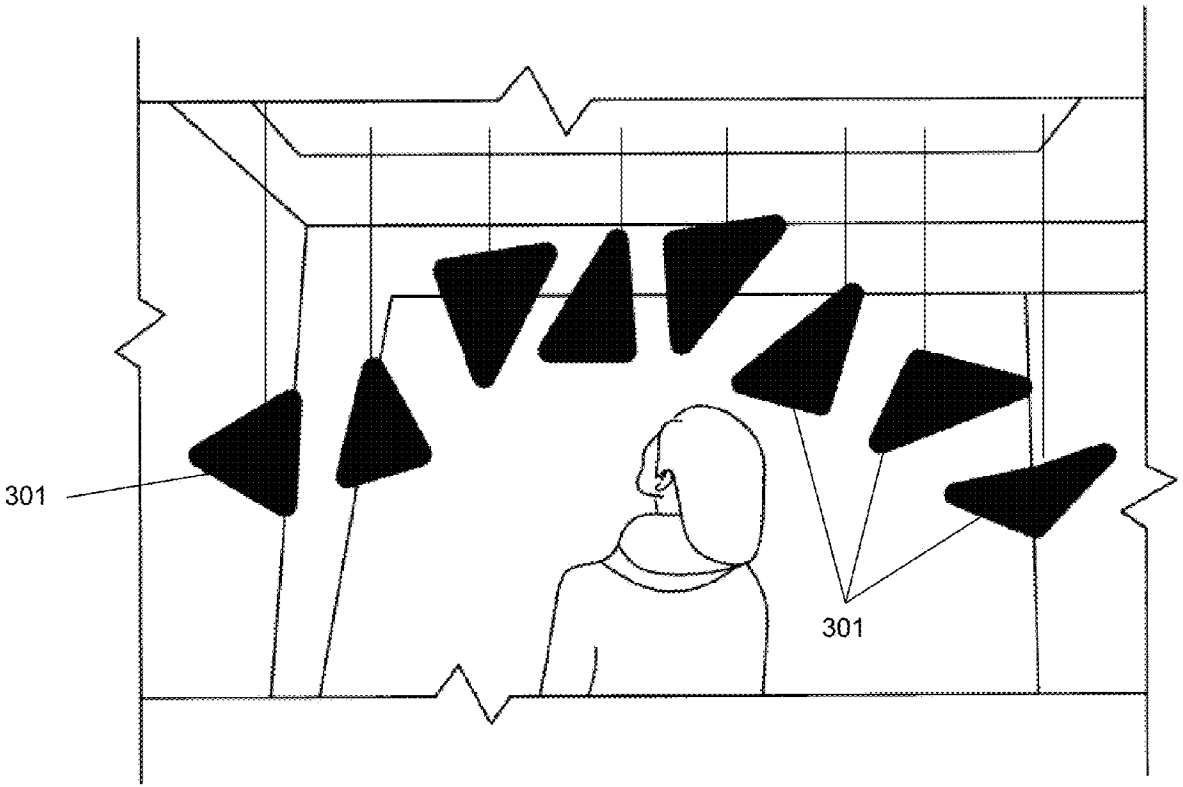
FIG. 3 illustrates an example ESL system implemented as suspended elements.

As such, as shown in FIG. 3, implementations where multiple hanging elements 301 are coordinated as a speaker array may be used to produce sound. Likewise, as for example illustrated in FIG. 4, an array where multiple speaker panels 403 coordinate may be formed. In an array, an example of which is shown in FIG. 2C, all loudspeakers may share a common ground plane.

As shown in FIG. 2C, the array allows electrostatic loudspeakers to be placed spatially, where each loudspeaker is controlled independently. Multiple sound patterns can be channeled through individual loudspeakers creating a moving, expressive and dynamic sound system. All loudspeakers in the array may have a common ground plane and use a single diaphragm surface, such as illustrated in FIG. 2C; however, this is not a requirement.

Figure 2D:
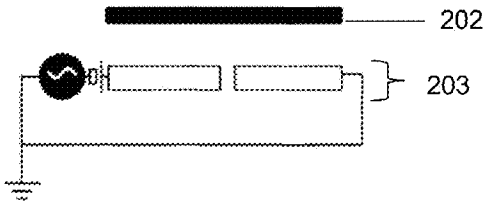

Referring to FIG. 2D, a passive speaker configuration is illustrated according to an embodiment. In this configuration, HV and ground electrodes are arranged on the same surface 203 plane, and an object with a passive diaphragm 202 (e.g., a conductive sheet of material or film, a conductive ink, etc.) is placed on top of the surface plane 203.

The surface 203 itself, e.g., tabletop including an electrode, cannot produce sound alone. However, the conductive surface of the passive element (including passive diaphragm 202) creates a difference in potential between the passive diaphragm 202 and the HV electrode (in surface 203) and ground. Changing the potential difference changes the electrostatic potential of the diaphragm 202. Therefore, the passive element behaves as a switch for sound reproduction.

Figure 2E:
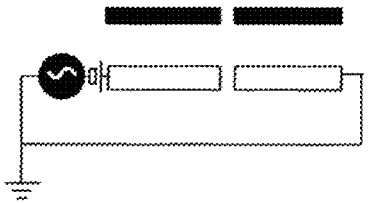

FIG. 2D shows the passive loudspeaker configuration generally. As with the other arrays described herein, the passive loudspeaker configuration of FIG. 2D, illustrated as having a single passive electrode 202, may be configured to use more than one electrode (or an array of electrodes), as illustrated in FIG. 2E.

Figure 5B:
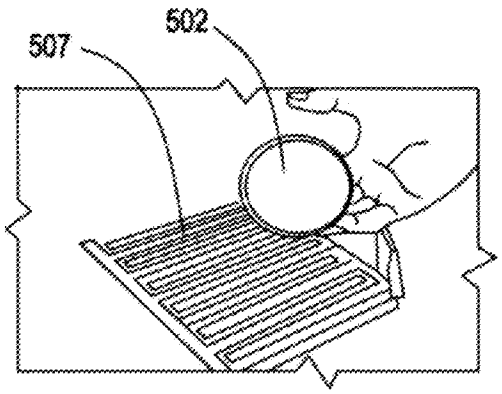
FIG. 5(A-C) illustrates an example ESL system using a passive diaphragm.
Figure 5A:
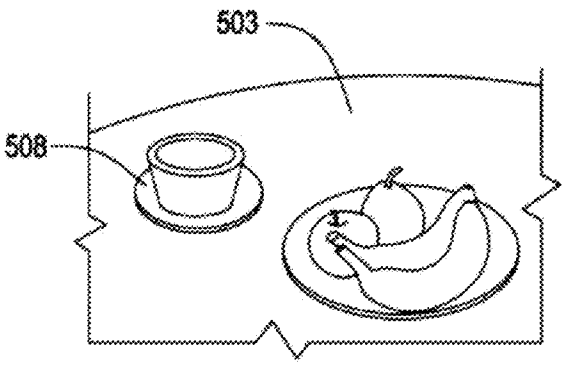

By way of example implementation, illustrated in FIG. 5A is a tabletop surface 503 that may be contain therein HV and ground electrodes. As more specifically illustrated in FIG. 5B and as generally outlined in FIG. 2D, HV and ground electrodes 507 cooperate with the passive diaphragm 502, e.g., included in the underside of an object 508, such as a plate 508 including a conductive material 502 (e.g., sheet or film disposed 502 on the bottom of the object 508). If the object or passive element 508 is placed on a surface such as a tabletop 503 that includes HV and ground electrodes 507, the combination of the object 508 (including the passive diaphragm 502) and the surface 503 (with HV and ground electrodes 507) act to form a functioning ESL.

Figure 5C:
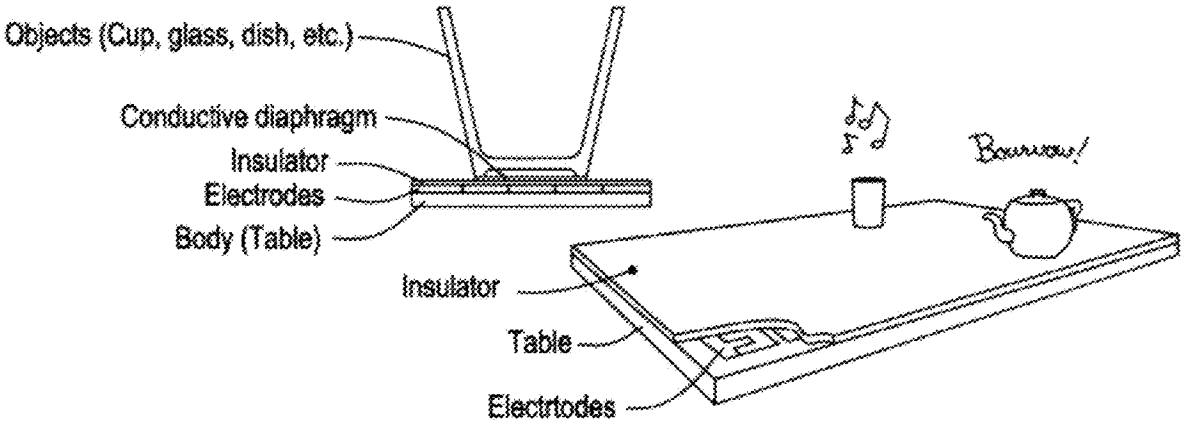

FIG. 5C illustrates a complete version of the ESL system using a passive diaphragm. As shown, the object (e.g., cup, glass, dish, etc.) provides a conductive diaphragm that is placed on the surface. The surface, e.g., a tabletop, includes electrodes and an insulating layer. Thus, the system is completed by placing the object on the surface such that the electrodes of the surface cause the object diaphragm to move (vibrate), reproducing the sound.

The embodiments are free-form in the sense that many different practical implementations may be chosen in forming functional ESLs. Due to the shape, size and flexibility in the electrostatic loudspeakers, applications to architecture, in furniture and with everyday objects is possible.

For example, architectural elements such as a large, curved wall may be fashioned to include a free-form electrostatic loudspeaker, as the ESLs described herein are amendable to inclusion in complex shapes due to their flexibility and scalability. Particularly this is facilitated by the flexibility of the materials used for forming the electrodes and diaphragms.

Figure 4:
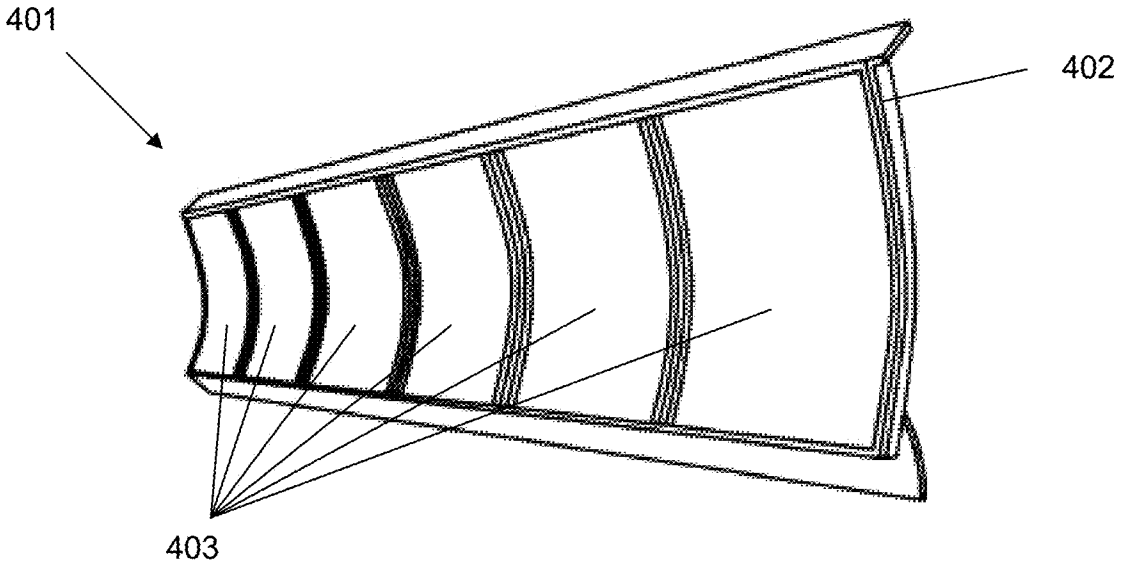
FIG. 4 illustrates an example ESL system implemented in a shaped wall element.

An example is shown in FIG. 4. This implementation allows for a highly immersive multisensory experience using a large, high definition curved display. Because an array type ESL was included in the example of FIG. 4, spatial sound makes objects sound and appear more realistic due to co-location of the sound with moving visuals. An array of six electrostatic loudspeaker electrodes 403 mounted on a curved frame (suitable for mounting on a wall) provides the effect of having six ESLs along the length of the curved display.

The array may be covered, e.g., with a single sheet of white paper (not shown), as a surface for projected graphics. The covering is not illustrated in FIG. 4 such that the underlying components, e.g., electrodes collocated with panels 403, are visible. A high definition projector, e.g., mounted on a ceiling opposite the curved array 401 projects animated video sequences on the display.

Instead of replicating an electronic driver for six channels, a multi-channel ESL driver may be used, e.g., consisting of multiple high voltage amplifiers using a single high voltage power supply. For example, a single 1000 V (1.25 mA) high voltage supply (EMCO, model QH10, Sutter Creek, Calif., USA) mounted on a motherboard provides a high voltage reference, up to eight channels. Using such an array 401, the sound experience may be designed in MAX/MSP that channels six outputs through a MOTU USB audio interface (model UltraLite-mk3 Hybrid, Cambridge, Mass., US). The array 401 in the example of FIG. 4 is divided into six sections or panels 403 and may be used for example to implement sound fading techniques, creating seamless sound movements related to the moving animated object movement within the large display.

The installation is highly immersive and users may touch the display. In order to avoid passing high voltages (current was limited to less than 1.25 mA) to guests, the ground potential electrode (e.g., metal mesh layer of panels 403) was placed on the outside (i.e., outer layer as illustrated) and the diaphragms (one being indicated at 402) for panels 403 connected to the high voltage audio signal were placed in between the wall and ground potential electrode (i.e., distal in the illustrated example of FIG. 4). Therefore guests could not touch the diaphragm 402.

Freeform ESLs are light and generate highly directional and uniform sound along the surface of diaphragm is produced. As such, the ESLs may be used for transforming room environments into sound systems, as shown in the creative concept in FIG. 3. In this example, suspended elements 301 may be used to produce sound, as each of the elements 301 may be included in an ESL array, e.g., as diagramed generally in FIG. 2C.

In addition to the features of ESLs described herein with respect to sound reproduction, ESLs may also be used as a microphone, e.g., with suitable modifications to the driver. In this case, the same electrostatic loudspeaker unit(s) may be used as a sound recoding and reproduction device.

For example, FIG. 3 shows moving speaker structures 301. The loudspeaker panels 301 may be suspended by thin strings from a supporting structure, e.g., a ceiling tile. The ESLs 301 may move in a variety of ways, e.g., by differing the lengths of the strings, such as via control by a series of servomotors. By varying the length of strings, the height and alignment of each panel 301 in the series may be varied. In addition to the use of the panels 301 as loudspeakers, they also may be used as microphones. For example, a user whispering into one of the panels 301 allows the sound to be transmitted via the movable element(s) of the ESL (e.g., diaphragm and/or electrode), such that the sound input may be recorded and played back, e.g., to another user standing further away from the whispering user and proximate to another of the panels 301.

Figure 6A:
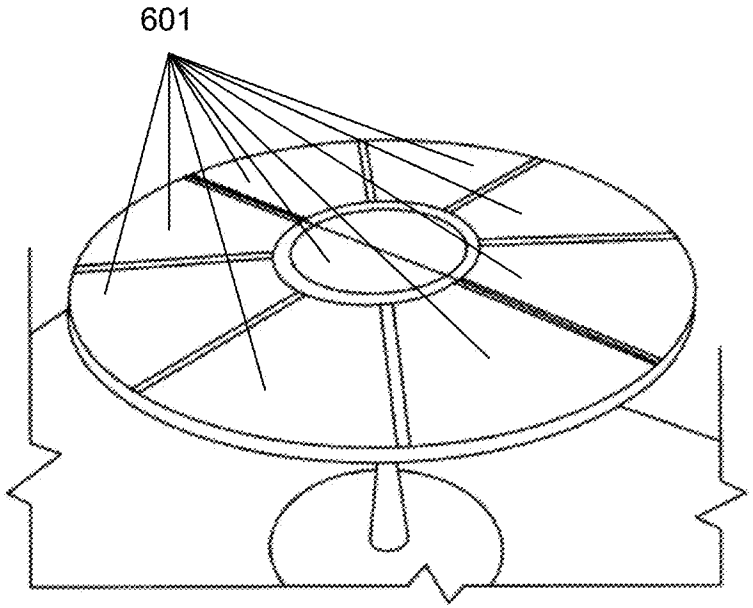
FIG. 6(A-B) illustrates an example ESL system implemented in a tabletop form.
Figure 6B:
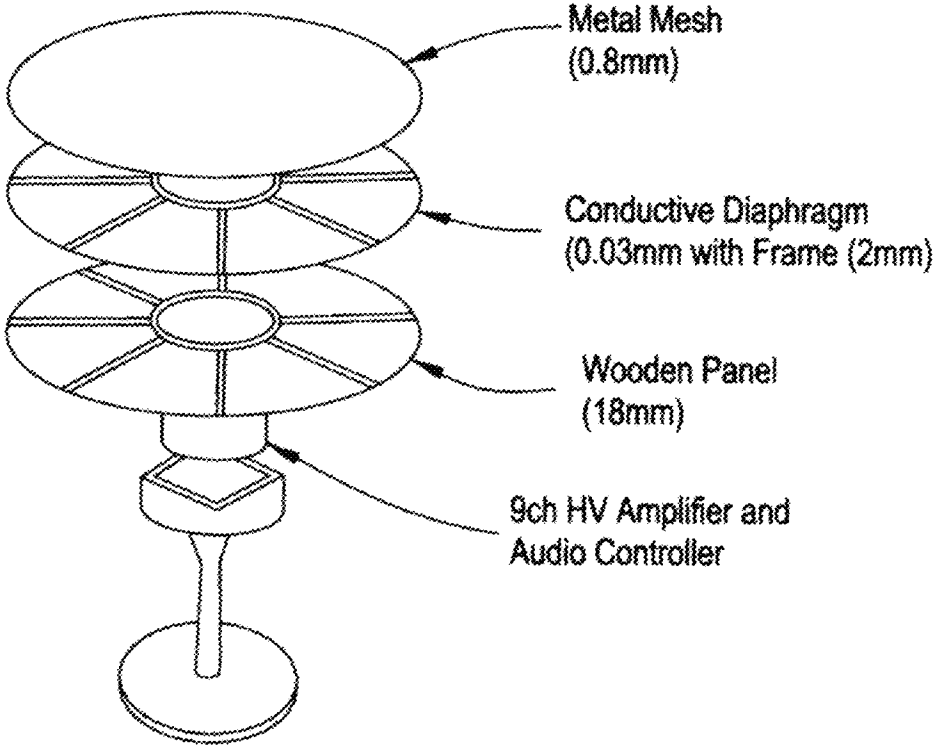

The ESLs may take a variety of shapes, e.g., incorporated into complex shapes such as furniture. By way of example, FIG. 6(A-B) illustrates an interactive tabletop implementation. In the example illustrated in FIG. 6(A-B), an array 601 of nine free-form ESLs on the top surface of a wooden table (refer to FIG. 6B) to enhance tabletop activity experiences. In this example, an array 601 of eight speakers are placed radially across the table and a ninth circular speaker is placed in the center, as shown in FIG. 6A. The conductive diaphragm is provided in this example implementation under a metal mesh (ground electrode, see for example FIG. 2B).

A software and hardware driver (HV amplifier and audio controller) used in this example (FIG. 6B) is similar to that used in the large curved wall installation illustrated in FIG. 4. A projector was mounted on the ceiling to project animated images on the table. The resulting installation could be used in a dining situation where interactive sound was produced while guests had a dinner served on the table. Due to the minimal effect of loading on the ESLs in the array 601, loads placed thereon (e.g., plates of food served on the table) do not affect sound quality.

Many other implementations are possible. For example, by using soft conductive cloth, cushions, pillows, mattresses and similar soft materials can also reproduce sound. A sound producing pillow for example may be made by wrapping two layers of conductive cloth around the pillow. Each conductive layer acts like a diaphragm. A normal non-conductive pillow cover wrapped around the conductive diaphragms isolates them from direct user touch. Low sound levels are reproducible by the soft pillow speaker because the distance between the two diaphragms is large, i.e., the layers are generally not close enough to reproduce enough audible sound. However, if the diaphragms are pressed against each other, light, perceivable sound is reproducible.

This sound level was sufficient to utilize the pillow because the head (and consequently the ears) are directly placed on the pillow. Other everyday objects such as toys and other tangible objects may likewise be utilized as loudspeakers according to embodiments.

For example, floating speakers, e.g., balloons and the like, may also be provided as the ESLs are lightweight in nature. Floating lightweight objects, such as balloons, may include a high voltage electrode placed inside the balloon with the outer diaphragm layer grounded. The quality of sound reproduced with these floating ESLs depends on the pressure of air inside the balloon. For example, a fully inflated balloon would generate louder sound than a half inflated balloon. In such implementations, other components (e.g., audio controller) may be connected to the ESL components producing the sound, e.g., a wired or wireless connection via input and/or output elements.

In some situations, interactions may be provided with passive, tangible objects, as illustrated in FIG. 5(A-B). In such cases, an object 508 equipped with a passive diaphragm layer 502 is placed on a fixed electrode pattern 507 embedded on a surface 503. FIG. 5B shows a table with a grid pattern electrode 507 made from conductive tape and the tangible object conductive layer 502. Similarly, heavy and light objects can be equipped with thin conductive layer and used as toys for playful user experience.

Loads placed on an ESL component, e.g., as for example provided by a passive element including a diaphragm as outlined in FIG. 5(A-C), have minimal effect on sound reproduction in most cases. Testing has shown that the overall shape of the frequency spectrum was maintained between loaded and unloaded states (load of 500 g). However, the intensity level was reduced by ~5 dB when a load of 500 g was placed on the loudspeaker.

In terms of power requirements, the operational principal of electrostatic loudspeakers is shown in Eq. 1. The overall loudness depends on the potential difference across the two surfaces, and not the current. Therefore, very minute current is required to generate sound (~1.5 mA). In electromagnetic speakers, current generates torque to move the mass in order to generate sound, which could require higher amperage, especially in large size speakers.

The performance of some example implementations of free-form ESLs was evaluated in terms of reliability and use in a variety of applications. All measurements were taken in a quiet room with background noise level below 45 dB digital sound pressure level (SPL).

An audio signal was generated through a personal computer output through an audio interface and passed through a transistor based driver, which amplifies the input signal from ~1$V_{p\text{-}p}$ to ~1000 $V_{p\text{-}p}$. The positive terminal of the output was connected to a fixed metallic mesh (acting as an electrode) and the ground terminal was connected to the diaphragm of the speaker. The sound was measured with a SPL meter (Extech Instruments Corp., model 407730, Nashua, USA) place 15 cm away from the surface of the speaker.

Figure 7:
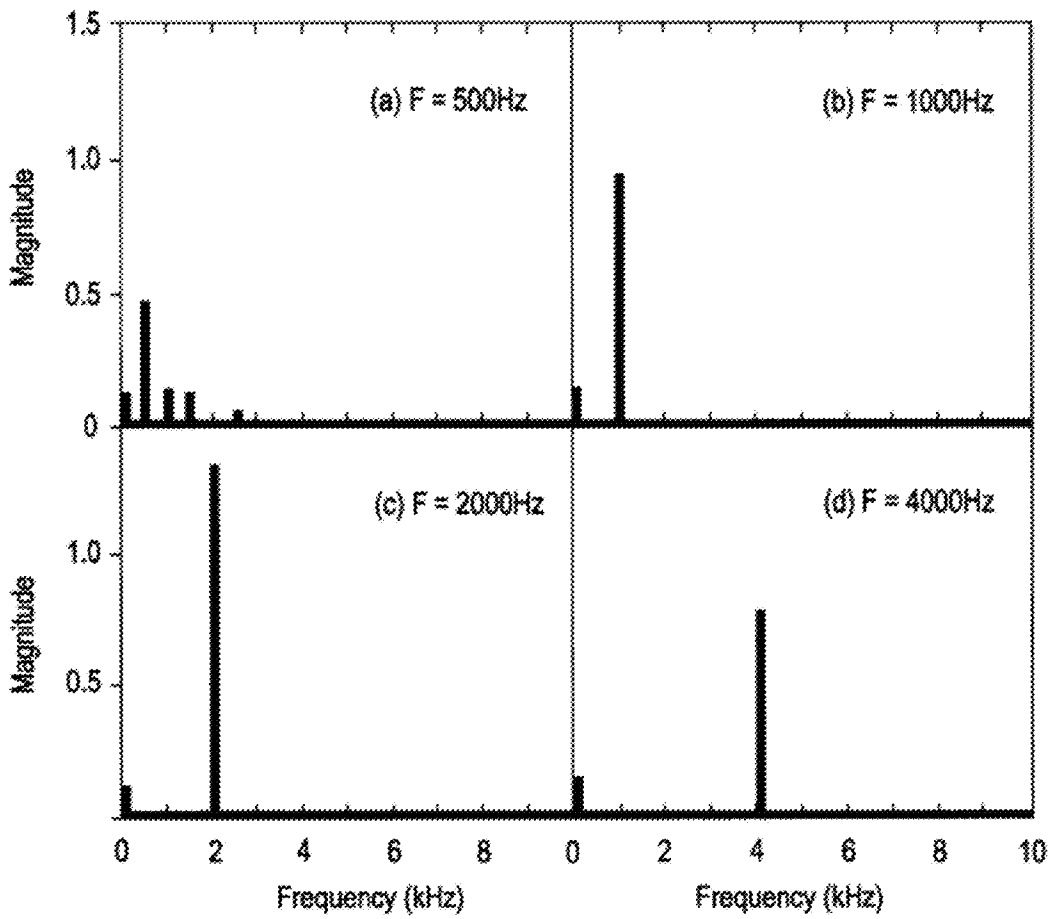
FIG. 7(A-D) illustrates an example FFT spectrum of ESLs at different frequencies.

The sound quality was measured by taking the frequency response of the speaker. Instead of running a typical frequency sweep, single frequency sinusoids were used to measure gain, distortion, harmonics and residual background noise levels. FIG. 7(A-D) shows the Fast Fourier Transform (FFT) spectrums of the measured sound signal at 0.5 kHz, 1 kHz, 2 kHz and 4 kHz. The magnitude of the FFT was normalized by number of samples. Distortion and harmonics of 500 Hz sinusoids were significant and could be sensed by a user with normal hearing level. At frequencies 1000 kHz and higher, signal distortion was low and quality of sound was noise free.

In terms of sound uniformity and sound directivity, a feature of the ESLs described herein is that the sound radiates uniformly throughout the surface of the speaker, which is not possible with point sound source of electromagnet speakers. FIG. 8(A-B) shows measurements taken from the SPL meter at seven locations (−200 mm, −100 mm, −50 mm, 0 mm, 50 mm, 100 mm and 200 mm) along the surface of two different sized ESLs. The two sizes of ESLs used had dimensions 150 mm long by 150 mm wide, and for the larger ESL, 350 mm long by 190 mm wide. The plotted data is normalized at 0 SPL of 0 mm measurements.

Figure 8A:
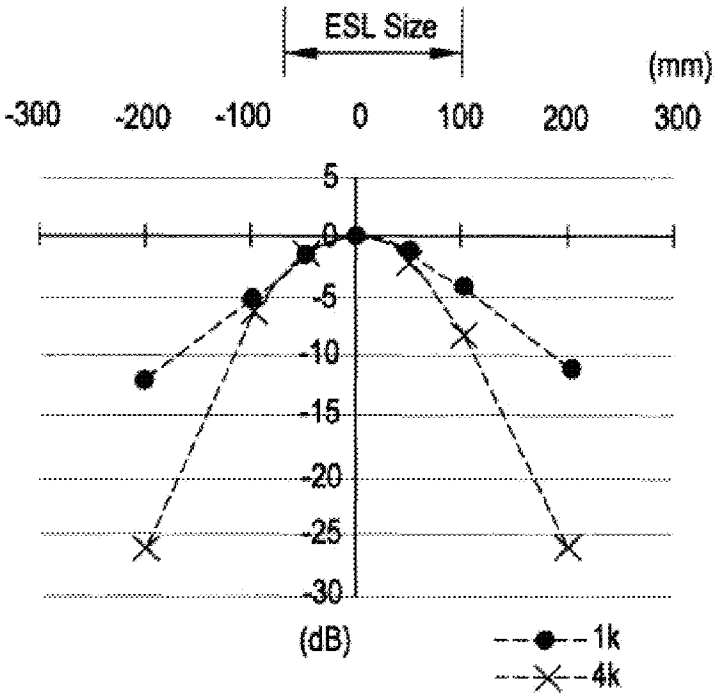
FIG. 8(A-B) illustrates sound pressure measurements along the surface of example ESLs.
Figure 8B:
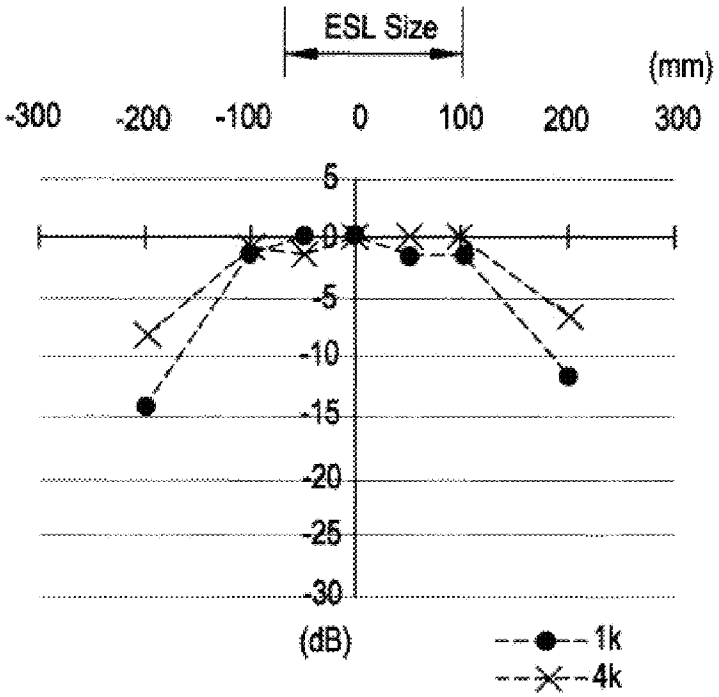

FIG. 8(A-B) shows sound measurements along the width of the smaller (FIG. 8A) and larger (FIG. 8B) ESLs. For the smaller loudspeaker, the maximum sound level was recorded at the center of the speaker and the sound intensity was maintained along most of the width before it steeply reduced towards the edges. Similarly, the sound intensity of the larger loudspeaker was not changed across the width of the loudspeaker and the sound intensity significantly decreased beyond its width. This shows that the electrostatic loudspeaker radiates sound uniformly along its surface and therefore is a good candidate for maintaining sound directivity.

Functionality of embodiments, e.g., providing sound inputs to drive sound reproduction and/or receiving audible inputs to record audible sounds of user, may be implemented using a variety of apparatuses or devices, e.g., a desktop computer, a laptop computer, a smart phone, etc. For example, a personal computer has been used in an example implementation with respect to an embodiment providing outputs to an ESL. Such a computing device may take the form of a device including the example components outlined in FIG. 9.

Figure 9:
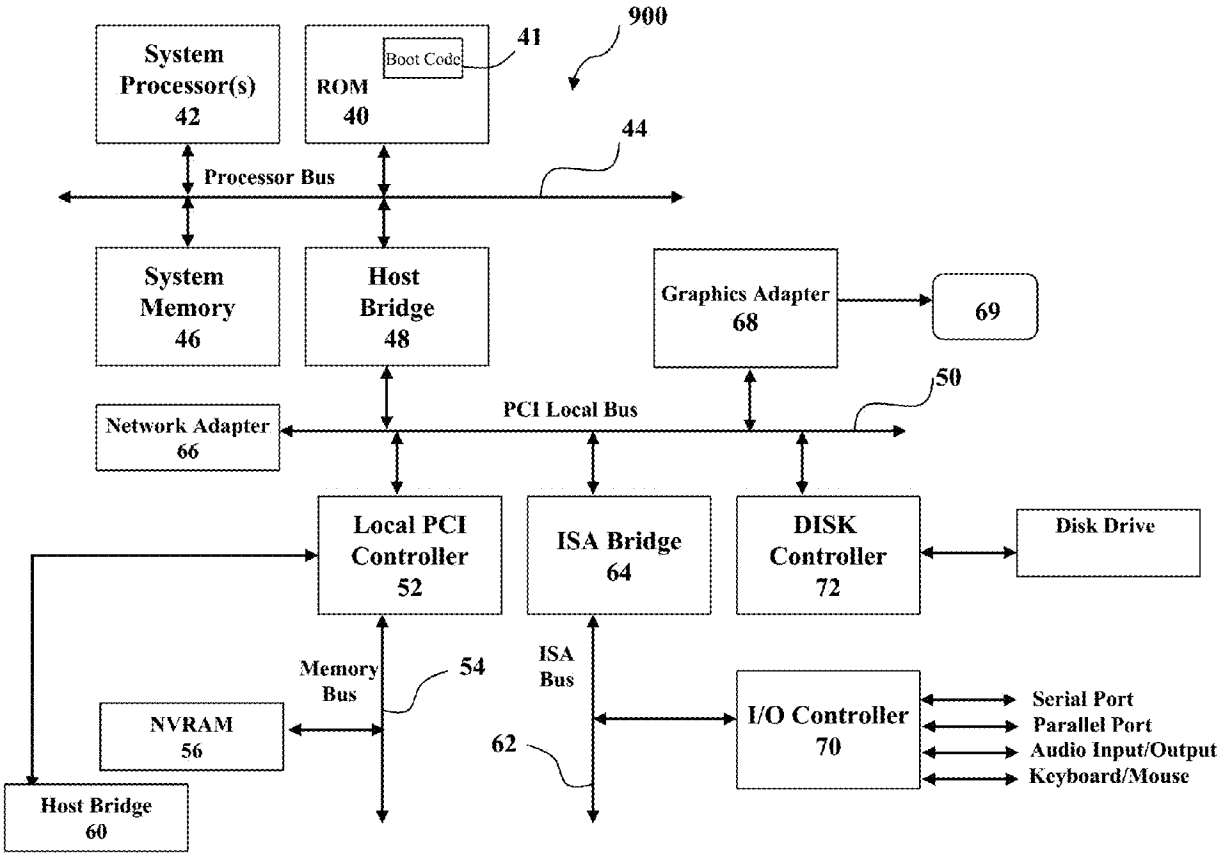
FIG. 9 illustrates an example computing system.

In FIG. 9, there is depicted a block diagram of an illustrative embodiment of a computer system 900. The illustrative embodiment depicted in FIG. 9 may be an electronic device such as workstation computer, a desktop or laptop computer, or another type of computing device used to process data such as transmitted or received audio data. As is apparent from the description, however, various embodiments may be implemented in any appropriately configured electronic device or computing system, as described herein.

As shown in FIG. 9, computer system 900 includes at least one system processor 42, which is coupled to a Read-Only Memory (ROM) 40 and a system memory 46 by a processor bus 44. System processor 42, which may comprise one of the AMD line of processors produced by AMD Corporation or a processor produced by INTEL Corporation, is a processor that executes boot code 41 stored within ROM 40 at power-on and thereafter processes data under the control of an operating system and application software stored in system memory 46, e.g., an application for providing audio output signals to an ESL, as described herein. System processor 42 is coupled via processor bus 44 and host bridge 48 to Peripheral Component Interconnect (PCI) local bus 50.

PCI local bus 50 supports the attachment of a number of devices, including adapters and bridges. Among these devices is network adapter 66, which interfaces computer system 900 to LAN, and graphics adapter 68, which interfaces computer system 900 to display 69. Communication on PCI local bus 50 is governed by local PCI controller 52, which is in turn coupled to non-volatile random access memory (NVRAM) 56 via memory bus 54. Local PCI controller 52 can be coupled to additional buses and devices via a second host bridge 60.

Computer system 900 further includes Industry Standard Architecture (ISA) bus 62, which is coupled to PCI local bus 50 by ISA bridge 64. Coupled to ISA bus 62 is an input/output (I/O) controller 70, which controls communication between computer system 900 and peripheral devices such as a as a keyboard, mouse, serial and parallel ports, audio input/output elements (e.g., communicating signals to or from an ESL speaker, as described herein), etc. A disk controller 72 connects a disk drive with PCI local bus 50. The USB Bus and USB Controller (not shown) are part of the Local PCI controller (52).

In addition to or as an alternative to the device or apparatus circuitry outlined above, as will be appreciated by one skilled in the art, various aspects of the embodiments described herein may be carried out using a system of another type, may be implemented as a device-based method or may embodied at least in part in a program product. Accordingly, aspects may take the form of an entirely hardware embodiment or an embodiment including software that may all generally be referred to herein as a "circuit," "module" or "system."

Furthermore, an embodiment may take the form of a program product embodied in one or more device readable medium(s) having device readable program code embodied therewith.

Any combination of one or more non-signal/non-transitory device readable storage medium(s) may be utilized. The storage medium may be a storage device including program code.

Program code embodied on a storage device may be transmitted using any appropriate medium, including but not limited to wireless, wireline, optical fiber cable, RF, etc., or any suitable combination of the foregoing.

Program code ("code") for carrying out operations may be written in any combination of one or more programming languages. The code may execute entirely on a single device, partly on a single device, as a stand-alone software package, partly on single device and partly on another device, or entirely on the other device. In some cases, the devices may be connected through any type of connection or network (wired or wireless), including a local area network (LAN) or a wide area network (WAN), or the connection may be made through other devices (for example, through the Internet using an Internet Service Provider) or through a hard wire connection, such as over a USB connection.

It will be understood that the actions and functionality illustrated or described may be implemented at least in part by program instructions or code. These program instructions or code may be provided to a processor of a device to produce a machine, such that the instructions or code, which execute via a processor of the device, implement the functions/acts specified.

The program instructions or code may also be stored in a storage device that can direct a device to function in a particular manner, such that the instructions or code stored in a device readable medium produce an article of manufacture including instructions which implement the functions/acts specified.

The program instructions or code may also be loaded onto a device to cause a series of operational steps to be performed on the device to produce a device implemented or device-based process or method such that the instructions or code which execute on the device provide processes/methods for implementing the functions/acts specified.

This disclosure has been presented for purposes of illustration and description but is not intended to be exhaustive or limiting. Many modifications and variations will be apparent to those of ordinary skill in the art. The embodiments were chosen and described in order to explain principles and practical application, and to enable others of ordinary skill in the art to understand the disclosure for various embodiments with various modifications as are suited to the particular use contemplated.

Although illustrative embodiments have been described herein, it is to be understood that the embodiments are not limited to those precise embodiments, and that various other changes and modifications may be affected therein by one skilled in the art without departing from the scope or spirit of the disclosure.

What is claimed is:

1. A free-form speaker system, comprising:

an audio controller;

an electrostatic speaker, comprising:

an array of free-form electrodes, wherein the array of free-form electrodes is shaped to substantially match a surface shape of an object; and one or more free-form diaphragms positioned proximate to, and being shaped to substantially match, the array of free-form electrodes;

at least one insulator, wherein the insulator is positioned between the array of free-form electrodes and the one or more free-form diaphragms;

the one or more free-form diaphragms being connected to ground;

the system comprising one or more input elements coupled to the array of free-form electrodes that accept inputs from the audio controller;

the array of free-form electrodes being connected to a high voltage input of the audio controller; and the audio controller actuating the one or more free-form diaphragms using an electrostatic force produced by the inputs from the audio controller.

2. The free-form speaker system of claim 1, wherein the one or more free-form diaphragms comprise a plurality of diaphragms, each of said plurality of diaphragms positioned proximate to a corresponding free-form electrode in the array of free-form electrodes.

3. The free-form speaker system of claim 2, wherein the one or more free-form diaphragms are disposed in a passive element physically removable from the array of free-form electrodes.

4. The free-form speaker system of claim 3, wherein the one or more free-form diaphragms comprises a conductive layer of the passive element.

5. The free-form speaker system of claim 4, wherein the passive element is a tangible object.

6. The free-form speaker system of claim 1, wherein the one or more free-form diaphragms are disposed in the object.

7. The free-form speaker system of claim 6, wherein the object is selected from the group consisting of a television, a wall, a tabletop, and a suspended element.

8. The free-form speaker system of claim 1, further comprising one or more elements coupled to the one or more free-form diaphragms that transmit audible inputs received by the one or more free-form diaphragms.

9. The free-form speaker system of claim 8, further comprising a memory device that records the audible inputs in reproducible form.

10. A lightweight, free-form electrostatic speaker, comprising:

at least one free-form electrode;

at least one free-form diaphragm positioned proximate to, and being shaped to substantially match, the at least one free-form electrode;

the at least one free-form diaphragm being connected to ground;

at least one insulator, wherein the at least one insulator is positioned between the at least one free-form electrode and the at least one free-form diaphragm; and one or more elements coupled to the at least one free-form electrode that accept inputs from an audio controller;

the at least one free-form electrode being connected to a high voltage input of the audio controller;

wherein the at least one free-form electrode and the at least one free-form diaphragm are formed of a flexible, lightweight conductive material selected from the group consisting of conductive paper, a conductive ink, a metal film, a polyester film, a carbon sheet, indium tin oxide, and a carbon nanotube material; and wherein the audio controller actuates the at least one free-form diaphragm using an electrostatic force produced by the inputs from the audio controller.

11. The free-form electrostatic speaker of claim 10, wherein the object is a floating object that is buoyant at 1 atmosphere pressure.

12. A free-form electrostatic speaker, comprising:

an audio controller;

an array of free-form electrodes, wherein the array of free-form electrodes is shaped to substantially match a surface shape of an object;

the array of free-form electrodes being connected to a high voltage input of the audio controller;

one or more free-form diaphragms disposed in the object and positioned proximate to, and being shaped to substantially match, the array of free-form electrodes;

the one or more free-form diaphragms being connected to ground; and one or more elements coupled to the array of free-form electrodes that accept inputs from the audio controller; and the audio controller actuating the one or more free-form diaphragms using an electrostatic force produced by the inputs from the audio controller.

13. The free-form electrostatic speaker system of claim 12, wherein the one or more free-form diaphragms comprise a plurality of diaphragms, each of said plurality of diaphragms positioned proximate to a corresponding free-form electrode in the array of free-form electrodes.

14. The free-form electrostatic speaker system of claim 12, wherein the object is selected from the group consisting of a television, a wall, a tabletop, and a suspended element.

15. The free-form electrostatic speaker system of claim 12, further comprising one or more elements coupled to the one or more free-form diaphragms that transmit audible inputs received by the one or more free-form diaphragms.

16. The free-form electrostatic speaker system of claim 12, further comprising a memory device that records the audible inputs in reproducible form.

17. A free-form electrostatic speaker system, comprising:

an audio controller:

at least one free-form electrode, wherein the at least one free-form electrode is shaped to substantially match a surface shape of an object;

the at least one free-form electrode being connected to a high voltage input of the audio controller;

the at least one free-form electrode disposed in a surface of the object such that it cooperates with a removable, passive diaphragm;

the removable, passive diaphragm being connected to ground;

at least one insulator, wherein the insulator is positioned between the at least one free-form electrode and the removable, passive diaphragm; and one or more elements coupled to the at least one free-form electrode that accept inputs from the audio controller;

the audio controller actuating the removable, passive diaphragm using an electrostatic force produced by the inputs from the audio controller.

18. The free-form electrostatic speaker system of claim 17, further comprising a high voltage amplifier.

19. The free-form electrostatic speaker system of claim 17, wherein the object is selected from the group consisting of a television, a wall, a tabletop, and a suspended element.

* * * * *